US007722514B2

(12) United States Patent
Paine, Jr.

(10) Patent No.: US 7,722,514 B2
(45) Date of Patent: May 25, 2010

(54) MULTI-DIRECTIONAL BODY SWING, TURN AND TWIST TRAINER WITH INTERCHANGEABLE AND ADJUSTABLE ATTACHMENTS

(75) Inventor: Robert A. Paine, Jr., Newark, DE (US)

(73) Assignee: BVP Holding, Inc., Newark, DE (US)

( * ) Notice: Subject to any disclaimer, the term of this patent is extended or adjusted under 35 U.S.C. 154(b) by 0 days.

(21) Appl. No.: 12/287,731

(22) Filed: Oct. 14, 2008

(65) Prior Publication Data

US 2009/0105055 A1 Apr. 23, 2009

Related U.S. Application Data

(60) Provisional application No. 61/000,056, filed on Oct. 23, 2007.

(51) Int. Cl.
*A63B 26/00* (2006.01)

(52) U.S. Cl. ..... 482/143; 482/70; 482/79; 482/142

(58) Field of Classification Search ..... 482/14, 482/142, 23–24, 33, 36–37, 62, 69, 79, 139, 482/143, 70–71

See application file for complete search history.

(56) References Cited

U.S. PATENT DOCUMENTS

| | | | | |
|---|---|---|---|---|
| 2,977,118 | A * | 3/1961 | Farkas | 482/35 |
| 5,330,398 | A * | 7/1994 | Barbafieri et al. | 482/23 |
| 5,403,253 | A * | 4/1995 | Gaylord | 482/43 |
| 5,518,470 | A * | 5/1996 | Piaget et al. | 482/51 |
| 5,518,476 | A * | 5/1996 | McLeon | 482/79 |
| 7,217,225 | B2 * | 5/2007 | Husted et al. | 482/51 |
| 2008/0004163 | A1 * | 1/2008 | Husted et al. | 482/57 |

* cited by examiner

*Primary Examiner*—Lori Baker
(74) *Attorney, Agent, or Firm*—Karl F. Milde, Jr.; Eckert Seamans Cherin & Mellott, LLC

(57) ABSTRACT

An exercise apparatus for providing multi-directional training to the body of a user is disclosed. The exercise apparatus allows the user to exercise the mid-section, hips, legs, ankles and connective tissues enjoining all the muscles in these areas. The exercise apparatus comprises a main frame, a foot platform (preferably two) and means for attaching the foot platforms to the main frame. The exercise apparatus is designed to be free standing or to be mounted onto other supporting structures. The apparatus has multiple interchangeable parts, attachments and accessories for allowing several types of exercises.

67 Claims, 12 Drawing Sheets

MULTI-DIRECTIONAL BODY SWING, TURN AND TWIST TRAINER WITH INTERCHANGEABLE AND ADJUSTABLE ATTACHMENTS

CROSS-REFERENCE TO RELATED APPLICATION

This present application claims benefit of priority from U.S. Provisional Application Ser. No. 61/000,056, filed Oct. 23, 2007, entitled "MUIULTI-DIRECTIONAL BODY SWING, TURN AND TWIST TRAINER WITH INTERCHANGEABLE AND ADJUSTABLE ATTACHMENTS".

FIELD OF INVENTION

The present invention relates to an exercise apparatus and more specifically to a multi-attachment exercise apparatus with interchangeable and adjustable parts for multi-directional training of the user.

BACKGROUND OF THE INVENTION

The human body moves in multi-planar directions and incorporates multitude of muscles all working in combination simultaneously in almost all aspects of life. Strength, mobility, flexibility, cardio-conditioning, balance, muscle awareness and coordination are all important during daily life particularly in the area of sports conditioning and movement but also in normal human activities found in everyday life like loading groceries into a car, walking the dog on a slippery sidewalk in the snow, raking leaves, etc. Existing exercise devices do not allow the user to train all these aspects simultaneously even though we live in a world that requires such skills.

Existing swing training fitness devices are designed to simulate the walking patterns of user. They are limited in their functionality and are usually fixed in a single use design. They swing forward and backward in an arced path, with the user standing on two pedals attached to two solid bars with a pivot point at about waist height and usually with the other end of each bar above the pivot point for the user to hold onto. As the user swings each leg alternatively forward and backward they stimulate a walking pattern. Such a device can be used for a cardio exercise but it provides very limited strength to the user. Exercises particularly in the mid-section, hips, legs, ankles and the connective tissues enjoining all of muscles in these areas are not provided by the existing fitness devices. Further, the training and coordination of the lower body in conjunction with the upper body is not served by these products.

SUMMARY OF THE INVENTION

The purpose of the present invention is to provide an exercise apparatus for allowing multi-planar and multi-directional training to the body of a user, wherein the exercise apparatus comprises a main frame, a plurality of foot platforms and means for attaching the foot platforms to the main frame. The main frame further comprises a holding bar, a plurality of support bars.

It is an object of the present invention to provide an exercise apparatus which allows a user to exercise mid-section, hips, legs, ankles and the connective tissues enjoining all of the muscles in these areas.

It is further an object of the present invention to provide an exercise apparatus to allow for training and coordination of the mid-section, hips, legs, ankles with the upper body of the user for better strength, mobility, flexibility, cardio-conditioning, balance, muscle awareness and coordination.

It is further an object of the present invention to provide an exercise apparatus to allow rotational and multi-directional ankle training.

It is further an object of the present invention to provide an exercise apparatus which can be mounted on devices having attaching means and supporting frame.

It is further an object of the present invention to provide a stand upon which an exercise apparatus can be mounted thereby making it a stand-alone product.

It is further an object of the present invention to provide an exercise apparatus which has multiple interchangeable parts, attachments and accessories allowing for various upper and lower body applications to be performed.

These objects, as well as other objects which will become apparent from the discussion that follows, are achieved, in accordance with the present invention.

The foregoing and other objects, features and advantages of the invention will be apparent from the following more particular description of the invention as illustrated in the accompanying drawings.

BRIEF DESCRIPTION OF DRAWINGS

FIG. 1, comprising

FIG. 2, comprising

FIG. 4, comprising

FIG. 5, comprising

DETAILED DESCRIPTION OF DRAWINGS

Figure 1A:
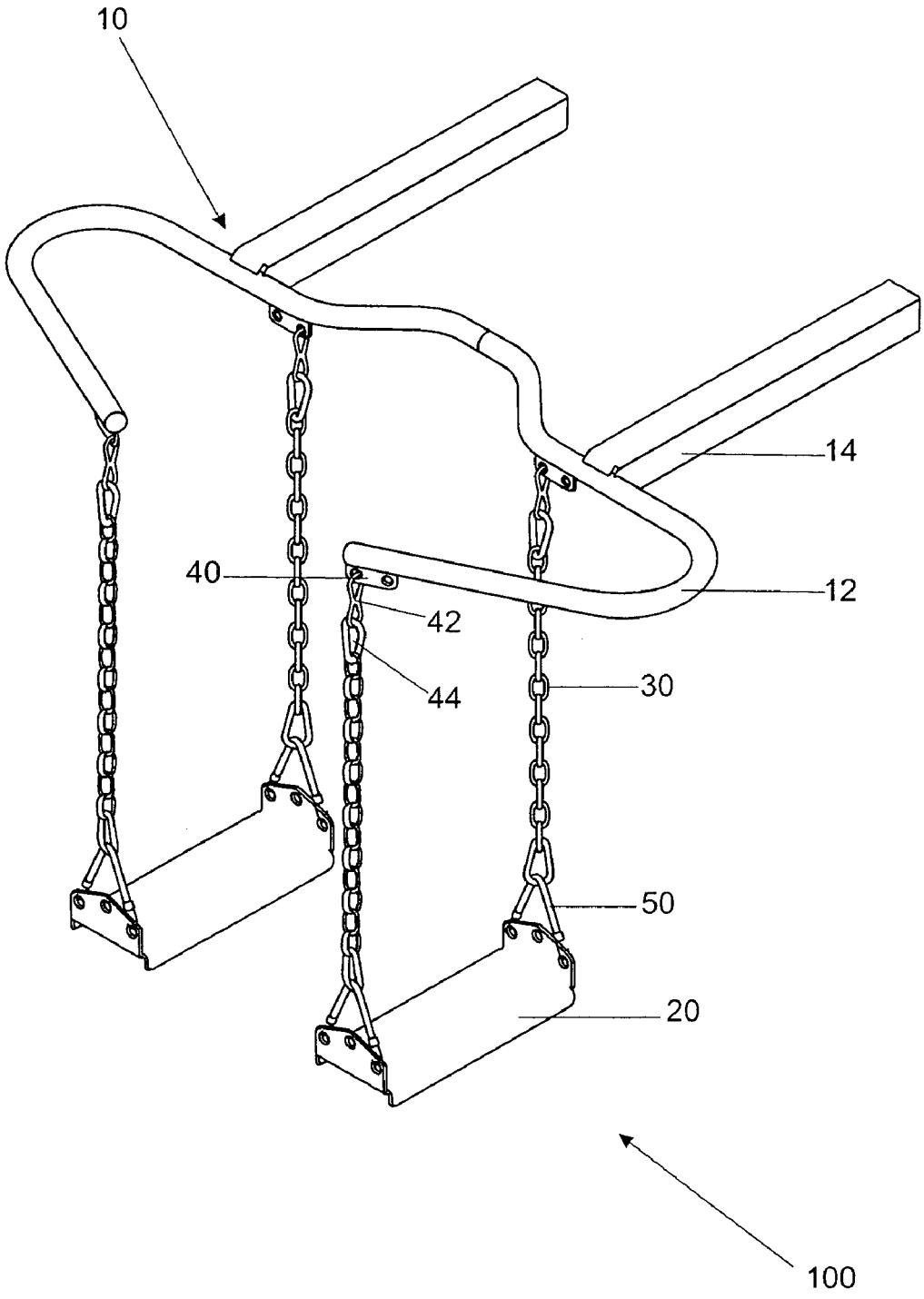
FIGS. 1*a*-1*d*, depicts the exercise apparatus 100 with its basic parts.

The preferred embodiments of the present invention will now be described with reference to FIGS. 1-5 of the drawings. Identical elements in the various figures are designated with the same reference numerals.

Embodiments of the present invention provide an exercise apparatus for multi-directional and multi-planar training of the body of the user. In the description of the present invention, numerous specific details are provided, such as examples of components and/or mechanisms, to provide a thorough understanding of the various embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

FIG. 1*a* illustrates an exercise apparatus 100 along with its various parts. The exercise apparatus 100 consists of a main frame 10 which supports foot platforms 20 substantially in parallel by means of hanging elements 30 such as chains, cables, ropes or bands. The main frame 10 comprises a C-shaped holding bar 12 and support bars 14. The holding bar 12 of the main frame 10 is attached to the support bars 14. The user steps on the foot platforms 20 and holds the holding bar 12 when commencing a workout. The support bars 14 are adapted to be attached to a mounting support, such as a wall or floor, with the aid of mounting means. The mounting support can be a wall, or a separate stand, or any supporting frame such as a SUPERCELL™ exercise system available commercially from Vortex Fitness Equipment is Wilmington, Del. The hanging elements 30 used to attach the main frame 10 to the foot platforms 20 are adapted for moving in multiple directions, with two degrees of freedom in an X-Y plane, thereby allowing the user to train his/her body in multi-directional patterns for better strength, mobility, flexibility, cardio-conditioning, balance, muscle awareness and coordination. Multiple connection points 40 on the holding bar 12 permit adjustment of the distance between the foot platforms 20, and also permit the foot platforms to be suspended at a slight angle (away from strictly parallel) to accommodate "pigeon toed" users and the like. The holding bar 12 has swivel snap hooks or clips 42 which are further attached to a carabiner 44 to lock the links of one end of the hanging elements 30. A snap hook or the carabiner 44 can be used to adjust the length of each respective hanging element 30. On the other end of the hanging elements 30, bungee cords or similar elastic members 50 can be attached so as to connect the hanging elements 30 to foot platforms 20. This gives the platform an additional degree of freedom of movement, in the vertical or "Z" direction, enabling the user to bounce up and down. Alternatively, non-elastic members can be used to connect the foot platforms 20 to the hanging elements 30.

In another embodiment only the carabiner 44 can be used to lock the links of the hanging elements 30. The present invention contemplates the use of swivel snap hooks 42, whereas other types of hooks or connecting means can be used without altering the scope of the invention.

Figure 1B:
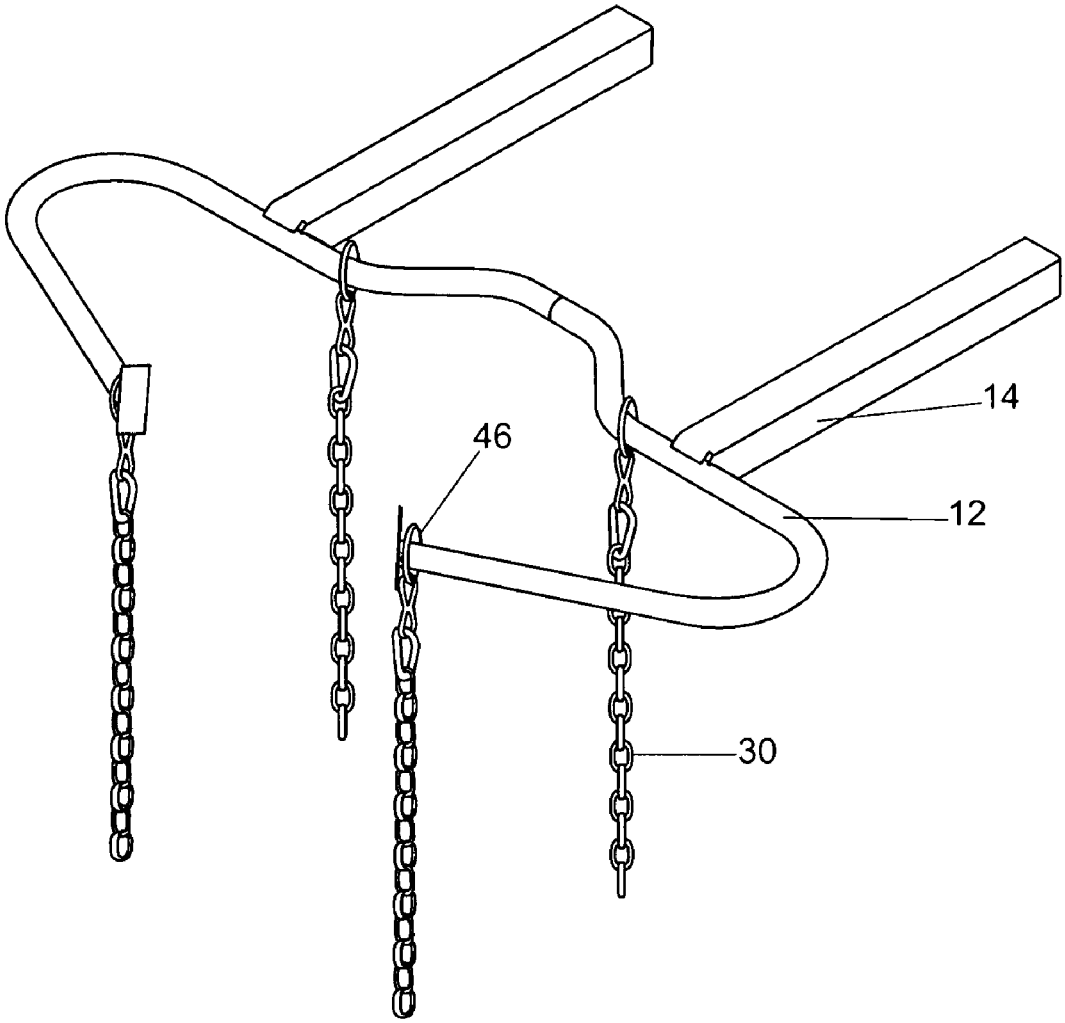

In another embodiment the hanging elements 30 are slidably attached to the main frame 10 as illustrated in FIG. 1*b*. Ring members 46 can be used to attach the hanging elements 30 to the holding bar 12, thereby allowing the user to adjust the points of attachment of the hanging elements 30 to the most comfortable position.

Figure 1C:
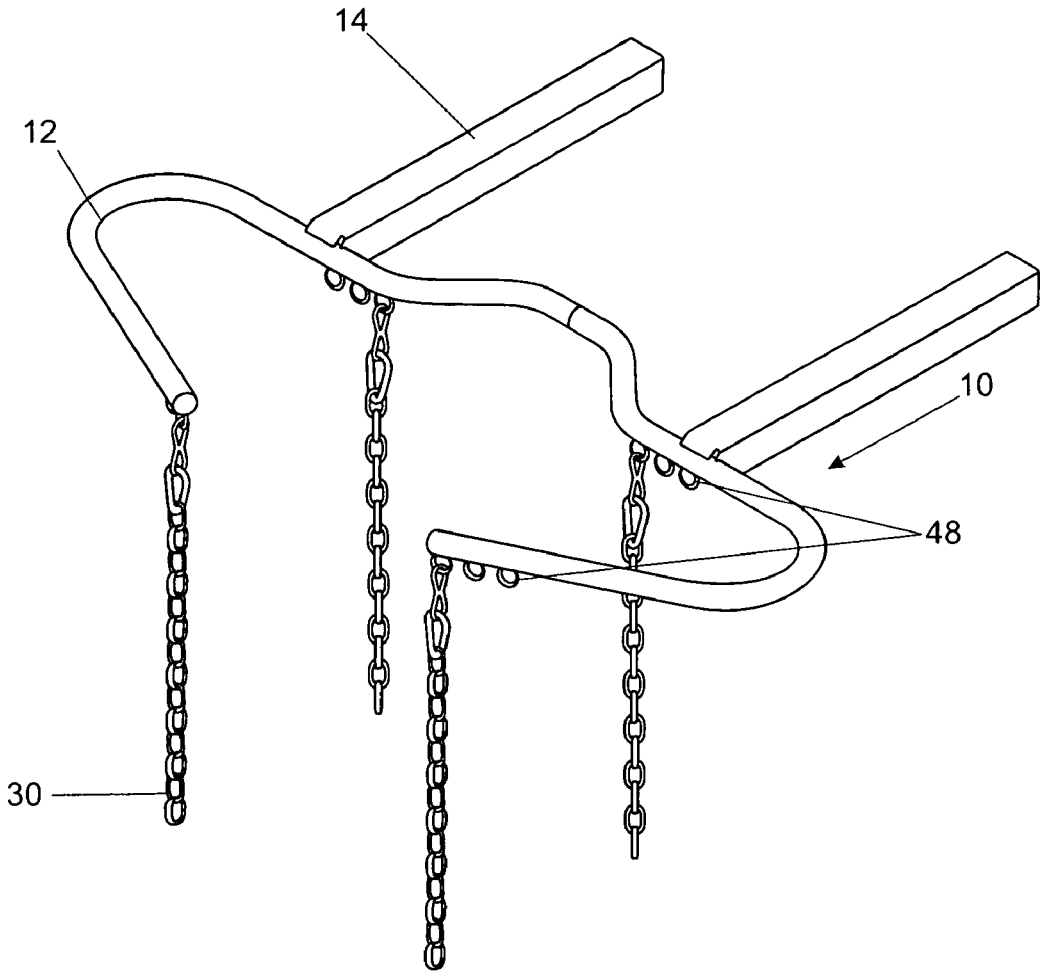

In still another embodiment, the holding bar 12 is provided with various connecting elements 48 to allow the user to attach the hanging elements 30 at specific points on the holding bar 12 as illustrated in FIG. 1*c*. Various other body types can also be attached to the holding bar 12 through these multiple connecting points.

Figure 1D:
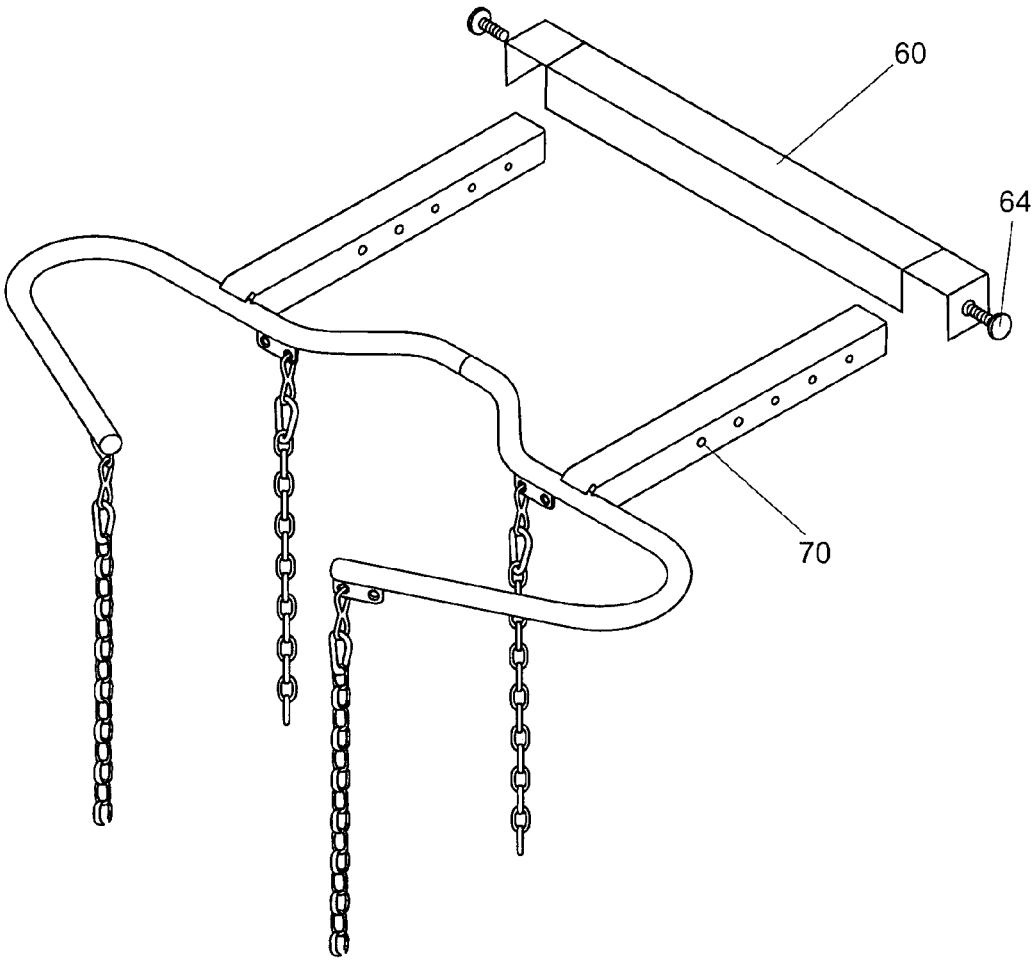

In still another embodiment, provisions 70 are made on the support bars 14 of the main frame 10 for accommodating crossbars 60 or similar structures as illustrated in FIG. 1*d*. The crossbars are affixed to the support bars by means of pop pins 64, or the like. Various accessories can be attached to the crossbars 60 to facilitate several types of workouts.

Figure 2A:
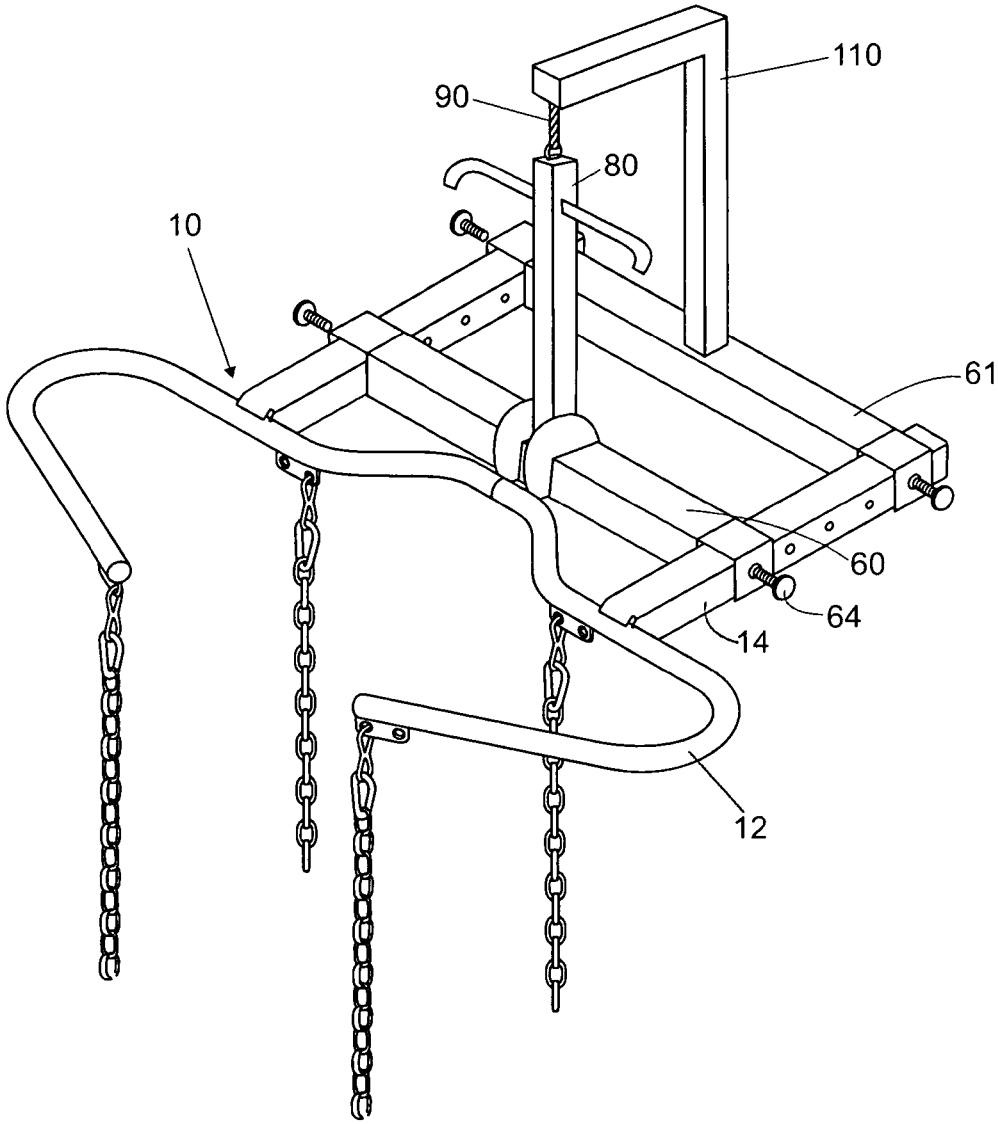
FIGS. 2*a* and 2*b*, depicts the exercise apparatus 100 with an attachment for upper body workout.

One such accessory can be a detachable device for upper body training as illustrated in FIG. 2*a*. This accessory allows the user to train the upper body either in unison or in isolation to the lower body. The attachment includes two horizontal handles mounted on an upright bar 80, the bottom end of which is pivotally mounted on a crossbar 60 fitted between the support bars 14 of the main frame 10. The bar 80 is lockable in a fixed upright position, or in any one of several different tilted positions, but when unlocked it can tilt freely in any direction.

Figure 2B:
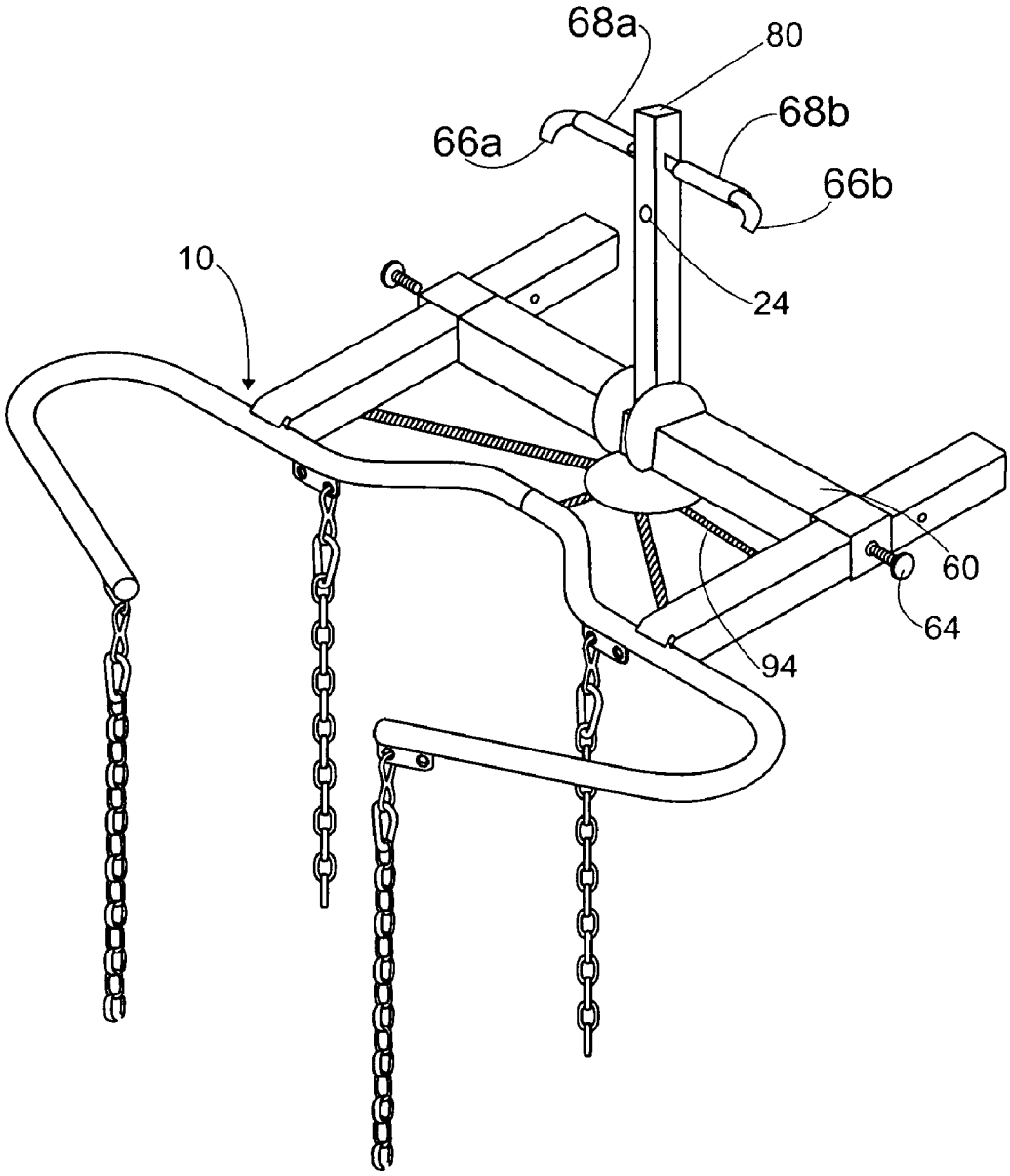
Figure 3:
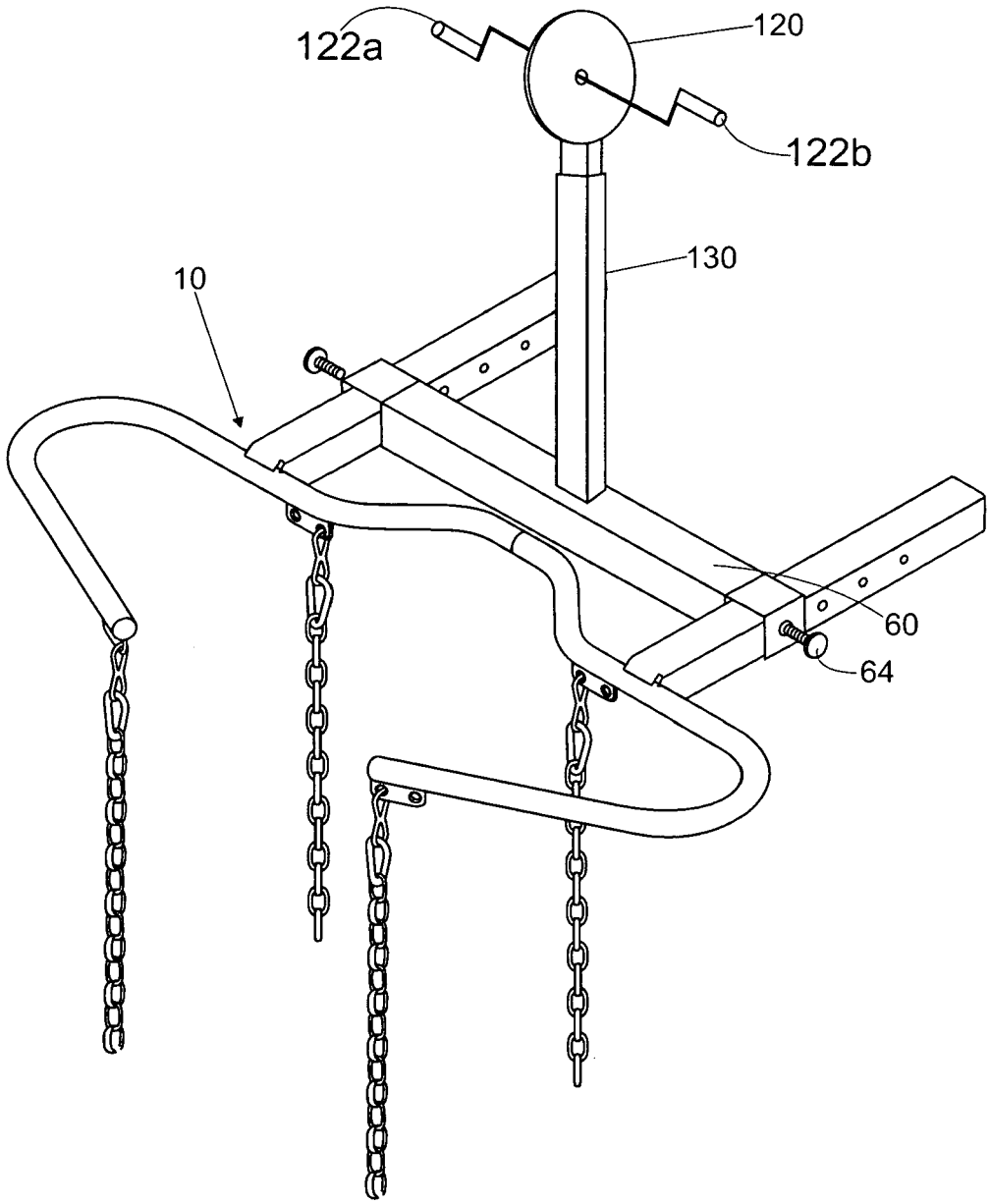
FIG. 3 depicts an upper body bicycle attachment for the exercise apparatus.

With the attachment shown in FIG. 2*a*, an elastic member 90 is used to provide resistance to tilting motion of the bar 80. One way of attaching an elastic member 90 is to connect it between the top end of the handle 80 and a post 110 attached to a second crossbar 61. Another way is to attach multiple elastic members 94 to the bottom of the bar 80 as shown in FIG. 2*b*. In this embodiment, one end of the elastic members is attached to the bottom end of the bar 80 and while the other end is attached at various points to the main frame 10. The bar 80, which is pivoted on the crossbar 60, can me moved in any direction away from the vertical using the handles 66*a* and 66*b*; however, it is continually biased toward the upright position by the elastic members 94. As in the case of the embodiment of FIG. 2*a*, the bar 80 in the embodiment of FIG. 2*b* can be locked in the upright position, or in one of a number of different non-upright positions as selected by the user, to prevent tilting movement. Another such upper body training accessory can be a detachable exercise bicycle device 120 with an adjustable resistance to facilitate an upper body workout of the user as illustrated in FIG. 3. The hand operated bicycle device 120 is mounted on a post 130 which is attached to the crossbar 60. When coupled to a device for measuring the energy expended by the user, this type of accessory is sometimes referred to as an "ergometer."

To provide information about the use of the exercise apparatus, a number of electronic sensors may be disposed at various points on the apparatus. For example, as shown in FIG. 2*b*, metal sensors 68*a* and 68*b* may be mounted on the handles 66*a* and 66*b*, respectively, to sense the heart rate of the user. A motion sensor 24 may be mounted on the movable bar 80 to sense the position, speed and/or acceleration of the bar.

On or more such motion sensors 122*a* and 122*b* may also be fitted to the hand-operated bicycle device, as shown in FIG. 3.

Figure 4A:
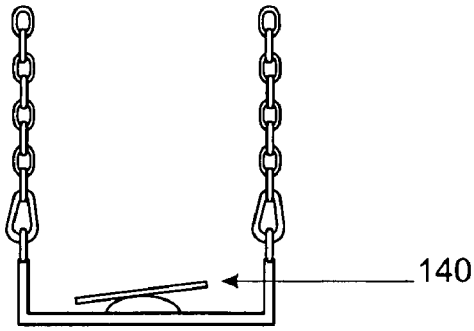
FIGS. 4*a*-4*d*, depicts various clip-ons for the foot platforms.
Figure 4B:
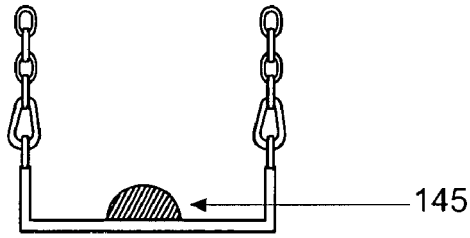
Figure 4C:
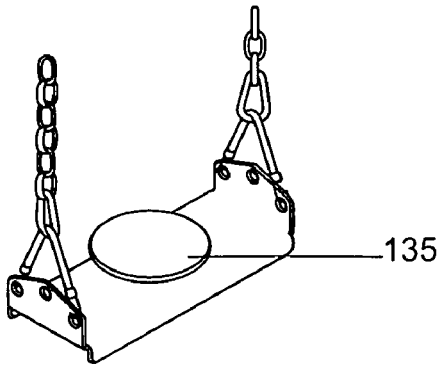

In still another embodiment, the foot platforms 20 are fitted with various accessories for ankle training in multiple directions. The accessory can be a pivotal circular plate 140 as shown in FIG. 4*a*. The accessory can also be a half ball 145 made up of a material such as rubber as shown in FIG. 4*b*. A rotatable disc 135 can also be used as an accessory for the foot platforms 20 for developing rotational strength of the ankle of user as shown in FIG. 4*c*. These accessories may be both attachable and detachable, so that the user can apply them to the foot platforms 20 whenever an ankle exercise is required.

Figure 4D:
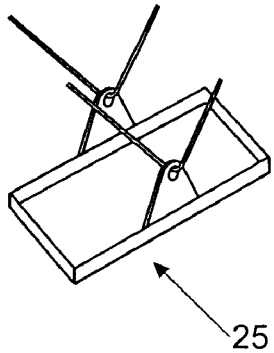

In still another embodiment, a foot platform 25 is pivoted centrally as shown in FIG. 4*d* so that the platform can rock up and down. This extra degree of freedom, in addition to the basic two degrees of freedom afforded the foot platform by the hanging elements 30, enables the user to perform ankle training.

Figure 5A:
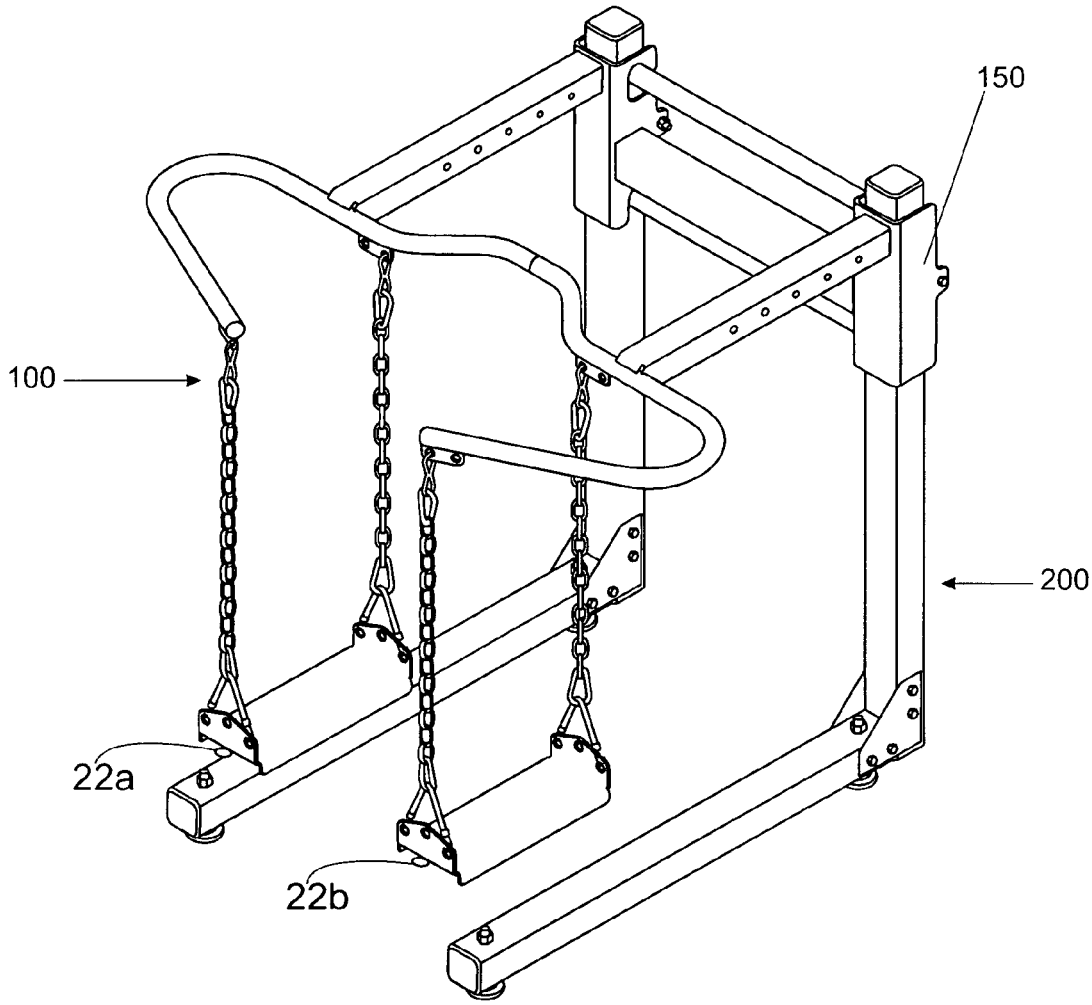
FIGS. 5*a*-5*e*, depicts a stand for the exercise apparatus.
Figure 5B:
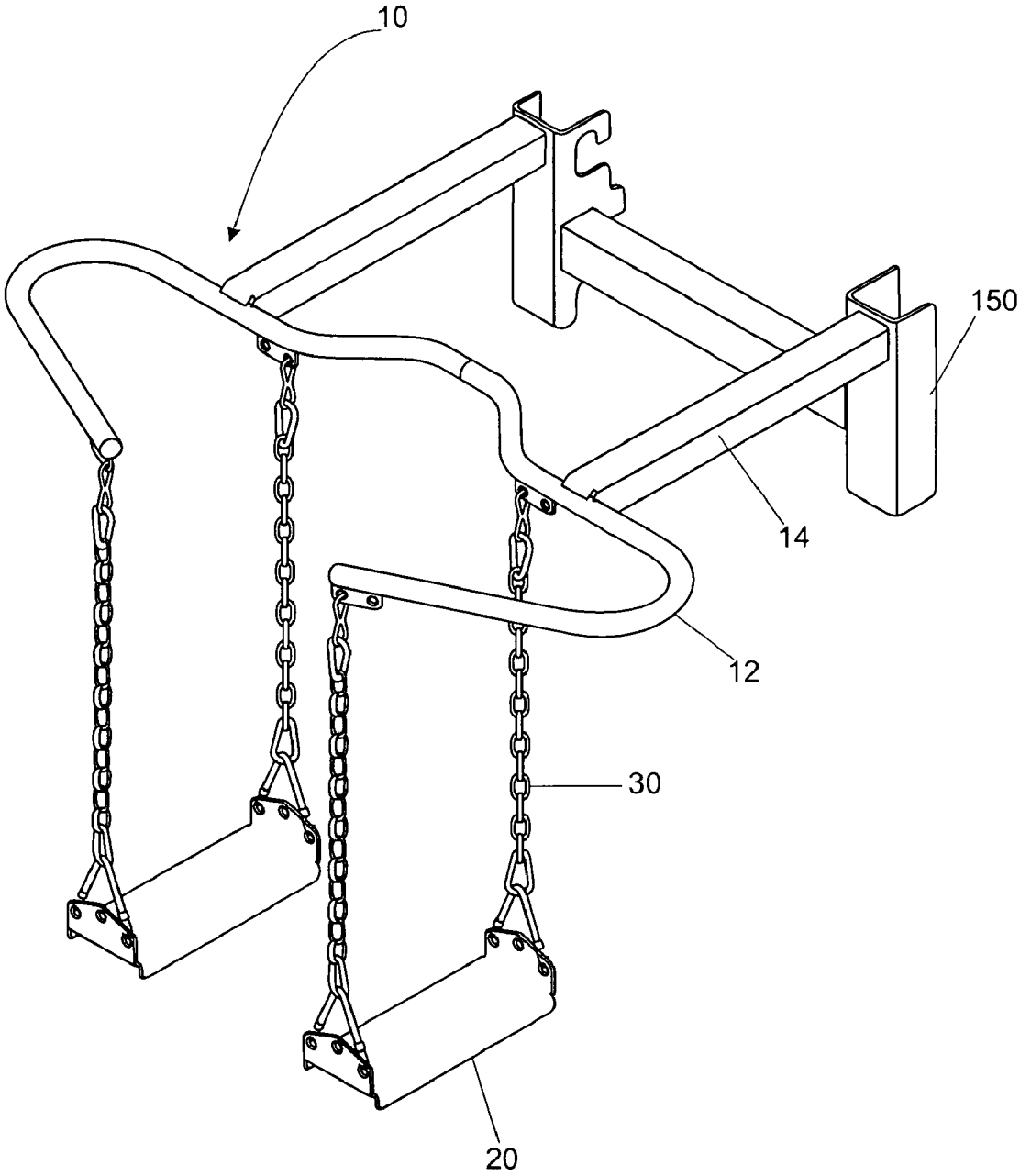

In still another embodiment, the exercise apparatus 100 is mounted on a stand 200 using a ladder hook-on assembly 150 thereby making it a stand alone product as shown in FIG. 5*a*. The ladder hook-on assembly 150 is attached to the support bars 14 of the main frame 10 of the exercise apparatus 100 as shown in FIG. 5*b*. Ladder hook-on assembly 150 helps in adjusting the height and position of the exercise apparatus 100 and can be attached or detached from the stand 200 as well as from the exercise apparatus 100 with ease.

Motion sensors 22*a* and 22*b* can be provided on the foot platforms to sense the motion imparted by the user. These and the other sensors that may be provided on the exercise apparatus are connected to an electronic system (not shown) for processing and signals and providing an image display in response to these signals.

Figure 5C:
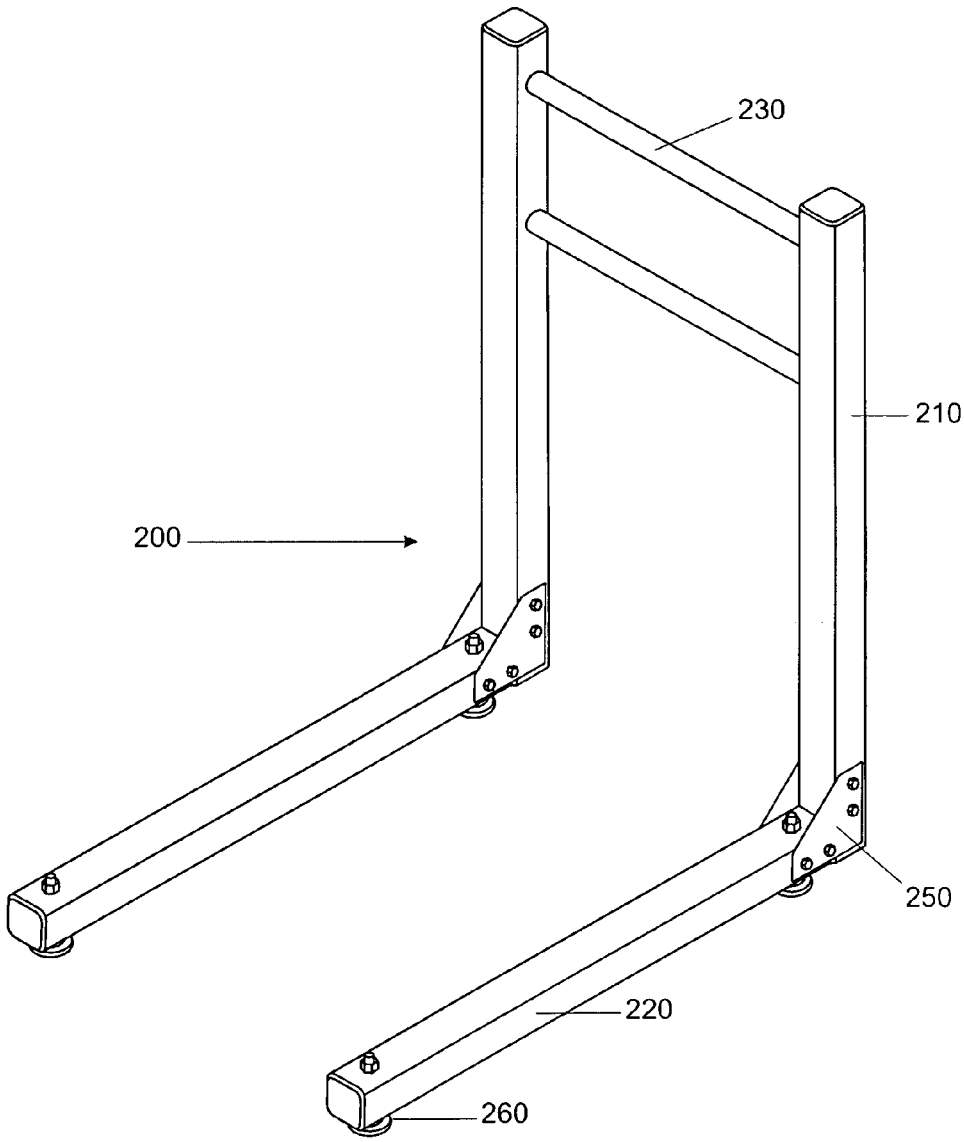
Figure 5D:
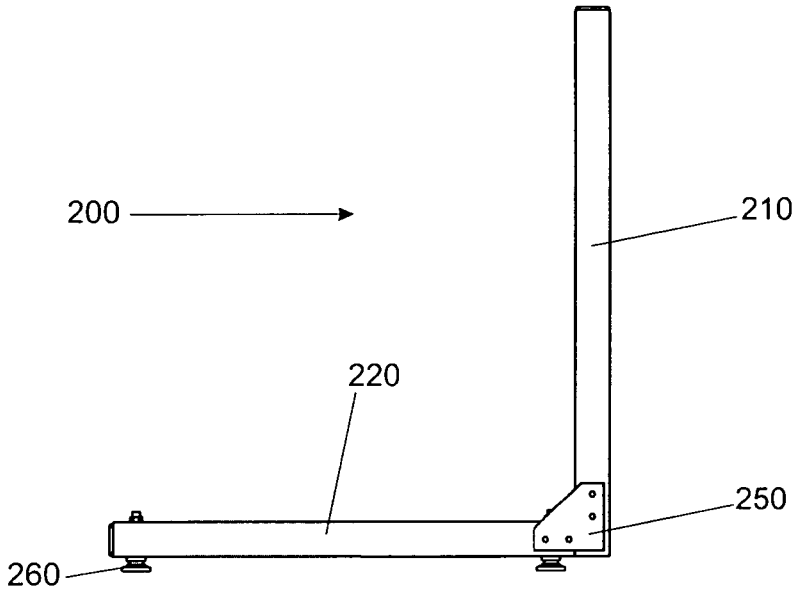
Figure 5E:
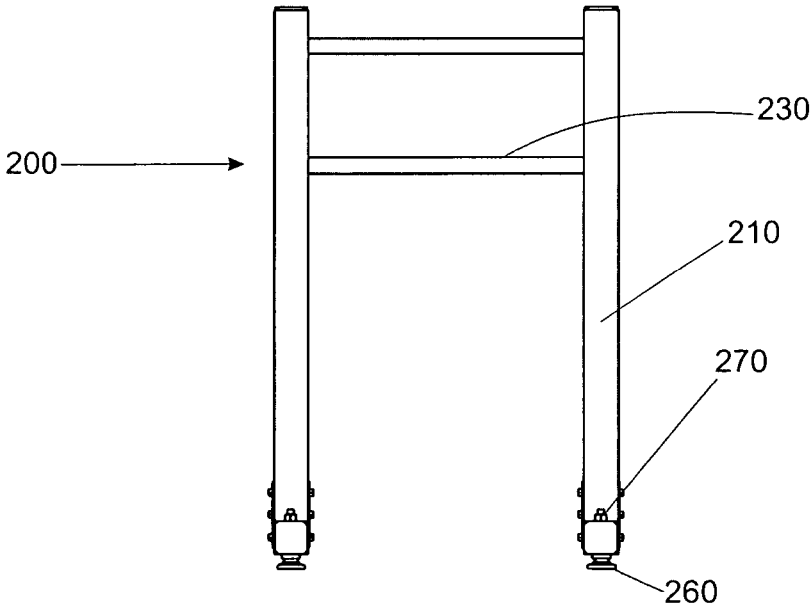

Exploded view of the stand 200 is illustrated in FIG. 5*c*. The stand 200 has vertical members 210 which are attached to each other by crossbar 230 forming a ladder—like frame structure. The vertical members 210 are attached to horizontal members 220 by well known means, such as gusset plates 250. The horizontal members 220 are provided with leveling feet 260 which can be adjusted to required height. The side view of the stand 200 as shown in FIG. 5*d* depicts the connection between the vertical members 210 and horizontal members 220 by the gusset plate 250 and the arrangement of the leveling feet 260 on the horizontal members 220. FIG. 5*e* depicts the use of hexagonal lock nuts 270 on the horizontal members 220 in attaching the feet 260.

The exercise apparatus 100 can also be mounted on wall or any supporting structure using standard mounting means.

In still another embodiment, the exercise apparatus 100 can be adapted to be used by a physically challenged person. A person having a disabled leg can rest the disabled leg on a foot rest mounted on the apparatus and perform the exercise with the other leg. Also, the exercise apparatus can be designed to be used by a person in a wheelchair. The user can perform upper body exercise by attaching an add-on to the main frame 10. A locking device can be provided to lock the wheelchair of the user to avoid movement of the wheelchair while the user is performing the exercise. Various other alterations in the design of the equipment can be made to help a physically challenged person in performing several types of exercises without changing the scope of the invention.

In still another embodiment, one or more sensors can be disposed within the exercise apparatus 100. The sensors can be integrated with a screen display for interactive use. The sensors can also be used to sense the heartbeat rate or other body conditions of the user in order to display these conditions on a screen and to notify the user about his/her physical health status. Various other types of sensors, such as pulse sensor, heart rate sensor, motion sensor and/or the like can also be used for information transfer between the exercise device and the user.

In still another embodiment, the exercise apparatus 100 can be equipped with electricity generating means to convert the physical energy of the user into electrical energy. Generated electrical energy can be used to power the exercise apparatus 100, lighting of the exercise room or the like.

While certain embodiments of the present invention have been illustrated and described, it will be clear that the present invention is not limited to these embodiments only. Numerous modifications, changes, variations, substitutions and equivalents will be apparent to those skilled in the art, without departing from the spirit and scope of the present invention, as described in the following claims.

What is claimed is:

1. An exercise apparatus for training the body of a user in multi-directional patterns, said exercise apparatus comprising:

a main frame including:

a) a holding bar providing two or more connecting points; and b) at least one support bar, connected to the holding bar, for attaching said holding bar to a supporting fixture to maintain the holding bar in a substantially horizontal configuration;

two foot platforms adapted to be attached to and hang from said holding bar in substantially parallel side by side arrangement, each of said foot platforms being adapted for movement in a substantially horizontal X-Y plane with at least two degrees of freedom; and at least one elongate hanging member, connecting each of said foot platforms to at least one of said connecting points on said holding bar, allowing said movement of said foot platforms in said X-Y plane with said at least two degrees of freedom.

2. The exercise apparatus according to claim 1, wherein said at least one hanging member is adjustable in length.

3. The exercise apparatus according to claim 1, which comprises two hanging members for attaching opposite sides of the foot platform to said holding bar.

4. The exercise apparatus defined in claim 2, which comprises two hanging members for attaching opposite sides of each foot platform to said holding bar.

5. The exercise apparatus according to claim 1, wherein said hanging member is a tension element selected from the group consisting of a chain, a band, a rod, a tube, a strap, a cable and a combination of at least two such tension elements.

6. The exercise apparatus according to claim 5, wherein said tension element is non-elastic.

7. The exercise apparatus according to claim 5, wherein at least a portion of said tension element is elastic, thereby supporting said foot platform with a third degree of freedom.

8. The exercise apparatus according to claim 5, wherein said tension element is flexible.

9. The exercise apparatus according to claim 1, wherein said holding bar is C-shaped and arranged in a substantially horizontal plane.

10. The exercise apparatus according to claim 1, wherein said hanging member for attaching said foot platform to said holding bar has a ring at one end adapted to slide over said holding bar to form a connecting point.

11. The exercise apparatus according to claim 1, wherein said hanging member for attaching said foot platform to said holding bar has a clip at one end for attachment to said holding bar at a connecting point.

12. The exercise apparatus according to claim 1, wherein said hanging member is detachable from said holding bar.

13. The exercise apparatus according to claim 1, further comprising an upper body training accessory, adapted to be attached to said main frame, for training upper body of the user, said accessory including:

a) at least one upright bar attached to said support bar; and b) a user handle attached to said upright bar.

14. The exercise apparatus according to claim 13, wherein said upright bar is movably attached to said support bar and further comprising resistance means for resisting motion of said upright bar.

15. The exercise apparatus according to claim 14, wherein the upright bar is lockable in one of a plurality of different positions to prevent movement thereof.

16. The exercise apparatus according to claim 14, wherein said resistance means includes an elastic member for biasing said upright bar in the upright position.

17. The exercise apparatus according to claim 14, wherein said upright bar is pivotally attached to said support bar.

18. The exercise apparatus according to claim 13, wherein said user handle includes a hand operated bicycle device.

19. The exercise device according to claim 18, wherein the bicycle device includes an adjustable resistance to rotation.

20. The exercise apparatus according to claim 13, which includes two parallel support bars and wherein said upright bar is attached to said two support bars by means of a crossbar.

21. The exercise apparatus according to claim 20, wherein said support bars are provided with means for easy attachment and detachment of said crossbar.

22. The exercise apparatus according to claim 1, wherein said connecting points also allow attachment of various fitness accessories to said holding bar.

23. The exercise apparatus according to claim 16, wherein said elastic member is attached on the top of said upright bar.

24. The exercise apparatus according to claim 16, wherein said elastic member is attached on the bottom of said upright bar.

25. The exercise apparatus according to claim 17, wherein said upright bar is pivoted with two degrees of freedom.

26. The exercise apparatus according to claim 1, further comprising an ankle training accessory, adapted to be attached to said foot platform.

27. The exercise apparatus according to claim 26, wherein said ankle training accessory is a circular pivot plate.

28. The exercise apparatus according to claim 26, wherein said ankle training accessory is a half ball.

29. The exercise apparatus according to claim 26, wherein said ankle training accessory is a rotatable disc.

30. The exercise apparatus according to claim 26, wherein said foot platform is centrally attached to allow it to rock up and down, thereby providing ankle training.

31. An exercise apparatus for training the body of a user in multidirectional patterns, said exercise apparatus comprising:

a) a supporting stand for mounting said exercise apparatus;

b) a main frame attached to said stand and comprising at least one substantially horizontal holding bar having two or more connecting points;

c) a plurality of substantially horizontal foot platforms adapted to be attached, substantially in parallel and side by side, to said holding bar at said connecting points for movement in a substantially horizontal X-Y plane with at least two degrees of freedom; and d) at least one tension element attaching one of each said foot platforms to at least one of said connecting points, thereby to suspend the respective foot platform from the respective connection point with said at least two degrees of freedom.

32. The exercise apparatus defined in claim 31, wherein the supporting stand comprises:

1) a plurality of first members;

2) a plurality of crossbars for attaching said at least two first members;

3) a plurality of second members supporting said first members; and 4) means for attaching said first members to said second members.

33. The exercise apparatus according to claim 32, wherein said first members are vertical members.

34. The exercise apparatus according to claim 32, wherein said second members are horizontal members.

35. The exercise apparatus according to claim 32, wherein said means for attaching said first members to said second members is a gusset plate.

36. The exercise apparatus according to claim 32, wherein said second members are equipped with plurality of leveling legs.

37. The exercise apparatus according to claim 31, wherein said connecting points also allow attachment of various accessories to said holding bar.

38. The exercise apparatus according to claim 31, wherein said tension element is selected from the group consisting of chain, band, rod, tube, strap, cable and a combination thereof.

39. The exercise apparatus according to claim 31, wherein said tension element is non-elastic.

40. The exercise apparatus according to claim 31, wherein at least a portion of said tension element is elastic, thereby supporting said foot platform with a third degree of freedom.

41. The exercise apparatus according to claim 31, wherein said tension element is flexible.

42. The exercise apparatus according to claim 31, wherein said holding bar is substantially C-shaped and arranged in a substantially horizontal plane.

43. The exercise apparatus according to claim 31, wherein said means for attaching said foot platform to said connecting points can slide over said holding bar.

44. The exercise apparatus defined in claim 31, wherein said tension elements are adjustable in length, whereby the height of said foot platforms may be adjusted.

45. The exercise apparatus according to claim 31, wherein said tension elements are elastic, whereby said foot platforms are suspended with three degrees of freedom.

46. The exercise apparatus defined in claim 1, wherein the distance between the connection points from which the foot platforms are suspended is adjustable, thereby to adjust the distance between the foot platforms.

47. The exercise apparatus defined in claim 31, wherein the distance between the connection points from which the foot platforms are suspended is adjustable, thereby to adjust the distance between the foot platforms.

48. The exercise apparatus according to claim 31, wherein said hanging member for attaching said foot platform to said holding bar has a clip at one end for attachment to said holding bar at a connecting point.

49. The exercise apparatus according to claim 31, wherein said hanging member is detachable from said holding bar.

50. The exercise apparatus according to claim 31, further comprising an upper body training accessory, adapted to be attached to said main frame, for training upper body of the user, said accessory including:

a) at least one upright bar attached to said support bar; and b) a user handle attached to said upright bar.

51. The exercise apparatus according to claim 50, wherein said upright bar is movably attached to said support bar and further comprising resistance means for resisting motion of said upright bar.

52. The exercise apparatus according to claim 51, wherein the upright bar is lockable in one of a plurality of different positions to prevent movement thereof.

53. The exercise apparatus according to claim 51, wherein said resistance means includes an elastic member for biasing said upright bar in the upright position.

54. The exercise apparatus according to claim 51, wherein said upright bar is pivotally attached to said support bar.

55. The exercise apparatus according to claim 50, wherein said user handle includes a hand operated bicycle device.

56. The exercise device according to claim 55, wherein the bicycle device includes an adjustable resistance to rotation.

57. The exercise apparatus according to claim 50, which includes two parallel support bars and wherein said upright bar is attached to said two support bars by means of a crossbar.

58. The exercise apparatus according to claim 57, wherein said support bars are provided with means for easy attachment and detachment of said crossbar.

59. The exercise apparatus according to claim 31, wherein said connecting points also allow attachment of various fitness accessories to said holding bar.

60. The exercise apparatus according to claim 53, wherein said elastic member is attached on the top of said upright bar.

61. The exercise apparatus according to claim 53, wherein said elastic member is attached on the bottom of said upright bar.

62. The exercise apparatus according to claim 54, wherein said upright bar is pivoted with two degrees of freedom.

63. The exercise apparatus according to claim 31, further comprising an ankle training accessory, adapted to be attached to said foot platform.

64. The exercise apparatus according to claim 63, wherein said ankle training accessory is a circular pivot plate.

65. The exercise apparatus according to claim 63, wherein said ankle training accessory is a half ball.

66. The exercise apparatus according to claim 63, wherein said ankle training accessory is a rotatable disc.

67. The exercise apparatus according to claim 63, wherein said foot platform is centrally attached to allow it to rock up and down, thereby providing ankle training.

* * * * *

UNITED STATES PATENT AND TRADEMARK OFFICE

CERTIFICATE OF CORRECTION

PATENT NO. : 7,722,514 B2
APPLICATION NO. : 12/287731
DATED : May 25, 2010
INVENTOR(S) : Robert A. Piane, Jr.

It is certified that error appears in the above-identified patent and that said Letters Patent is hereby corrected as shown below:

ON THE TITLE PAGE:

Item (12) should read: Piane, Jr.

ON THE TITLE PAGE, LEFT COLUMN:

Item (75) Inventor should read: Robert A. Piane, Jr.

Signed and Sealed this

Twenty-fourth Day of August, 2010

David J. Kappos

David J. Kappos
*Director of the United States Patent and Trademark Office*